US006977352B2

(12) United States Patent
Oosawa

(10) Patent No.: US 6,977,352 B2
(45) Date of Patent: Dec. 20, 2005

(54) TRANSMISSIVE KEY SHEET, INPUT KEYS USING TRANSMISSIVE KEY SHEET AND ELECTRONIC EQUIPMENT WITH INPUT KEYS

(75) Inventor: Kazuo Oosawa, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 11/067,920

(22) Filed: Mar. 1, 2005

(65) Prior Publication Data

US 2005/0167254 A1 Aug. 4, 2005

(30) Foreign Application Priority Data

Mar. 2, 2004 (JP) ..... 2004-057595

(51) Int. Cl.[7] ..... H01H 13/70

(52) U.S. Cl. ..... 200/314; 200/512; 200/341; 200/517

(58) Field of Search ..... 200/5 A, 512, 200/517, 341, 345, 310, 314, 317; 400/490, 400/491, 491.2, 495, 495.1, 496; 341/22; 345/168–170

(56) References Cited

U.S. PATENT DOCUMENTS

| | | | | |
|---|---|---|---|---|
| 5,911,317 | A | 6/1999 | Tsai | |
| 6,621,027 | B1 * | 9/2003 | Shimizu et al. | 200/341 |
| 6,677,545 | B2 * | 1/2004 | Kenmochi | 200/314 |
| 6,723,936 | B2 * | 4/2004 | Ootsuka et al. | 200/517 |
| 6,762,381 | B2 * | 7/2004 | Kunthady et al. | 200/512 |
| 6,770,212 | B2 * | 8/2004 | Hayashizaki | 200/341 |

FOREIGN PATENT DOCUMENTS

| | | | |
|---|---|---|---|
| EP | 1056107 | A2 | 11/2000 |
| EP | 1164606 | A2 | 12/2001 |
| JP | 2003-217396 | A | 7/2003 |
| WO | WO 00/63924 | A1 | 10/2000 |

* cited by examiner

*Primary Examiner*—Michael A. Friedhofer
(74) *Attorney, Agent, or Firm*—Sughrue Mion, PLLC

(57) ABSTRACT

A transmissive key sheet using translucent resin, which is capable of effective illumination while ensuring the thinness of the entire key sheet as well as suppressing a decrease in light transmission, input keys using the transmissive key sheet, and electronic equipment with the input keys. A transmissive key sheet of input keys comprises a first key sheet unit and a second key sheet unit, the opposite side of the first key sheet unit from key tops and the opposite side of the second key sheet unit from pressure applicators being bonded together with a translucent adhesive. The key tops made of translucent resin are molded integral with a translucent resin film having letters on its under surface to provide the first key sheet unit. The pressure applicators made of translucent resin are molded integral with a translucent resin film to provide the second key sheet unit. The light from a light source on a substrate illuminates keys so that the letters printed on the under surface of the translucent resin film become visible form outside. The pressing of each key top presses a corresponding key switch through the pressure applicator, and the key switch is concavely curved to make a contact with an electrode on the substrate. Thus, key input is provided.

14 Claims, 8 Drawing Sheets

1A,1B: KEY SHEET UNIT 1A,1B: KEY SHEET UNIT

TRANSMISSIVE KEY SHEET, INPUT KEYS USING TRANSMISSIVE KEY SHEET AND ELECTRONIC EQUIPMENT WITH INPUT KEYS

FIELD OF THE INVENTION

The present invention relates to a transmissive key sheet used for input keys having translucent resin key tops on electronic equipment including various types of terminal equipment or mobile communication equipment such as cellular phones and automobile phones, input keys using the transmissive key sheet, and electronic equipment with the input keys.

BACKGROUND OF THE INVENTION

It has been well known to use key tops made of translucent resin for input keys or buttons of the input unit of electronic equipment including various types of terminal equipment or mobile communication equipment.

There are two types of such input keys having translucent resin key tops. Input keys of the first type have pressure applicators made of silicon rubber, while those of the other type have key tops integrated with a film as disclosed in Japanese Patent Application laid open No. 2003-217396.

FIG. 1 is a cross section diagram showing conventional input keys in the first type. As shown in FIG. 1, input keys 31 are formed by gluing key tops 32 made of translucent resin onto the upper surface of a keypad 33 with a translucent adhesive. The keypad 33 is formed of a translucent silicon rubber sheet and provided with protruding pressure applicators 33*a* in positions opposite to the respective key tops 32. The input keys 31 are mounted on a housing 38 so that the key tops 32 are exposed to outside. In the housing 38, key switches 37 are arranged on a substrate 34 so as to be opposite to the respective pressure applicators 33*a*. A reinforcing board 35 supports the substrate 34. The pressing of the key top 32 presses the key switch 37 through the pressure applicator 33*a*, thereby bringing the key switch 37 in contact with an electrode (not shown) on the substrate 34. Thus, key input is provided. The light from a light source 36 on the substrate 34 transmits through the translucent keypad 33, and illuminates the keys to make letters, symbols, etc. printed on the under surfaces of the key tops 32 visible from outside through the key tops 32.

In this construction, however, the silicon rubber keypad 33 having the pressure applicators 33*a* is bonded to the key tops 32, which consequently necessitates an increase in thickness. Besides, since silicon rubber assumes a milk-white color even though it is translucent, the transmission decreases due to lower brightness or luminance.

In order to solve such problems, there have been proposed techniques in which key tops are integrated with a film as for example disclosed in Japanese Patent Application laid open No. 2003-217396.

FIG. 2 is a cross section diagram showing the construction of a conventional key sheet formed of key tops integrated with a film. According to the conventional technique, as shown in FIG. 2, a key sheet 41 is formed of a 50 to 250-□m thick resin film 43 having convexities and key tops 42 made of a resin member integrated with the back side of the resin film 43. The respective key tops 42 are provided with protruding pressure applicators 42*a*.

With this construction, the increase of thickness can be prevented as compared to the conventional input keys of the first type having the pressure applicators made of silicon rubber. However, in the case of keys integrated with a film described as in Japanese Patent Application laid open No. 2003-217396, key tops have pressure applicators thereunder. Accordingly, in order that the prints of letters, symbols, etc. are provided on the upper surface of the key tops and also fingers will not touch them, the key tops need to be covered with a film having the prints on it. Such film causes a decrease in the light transmission of the entire key sheet. In addition, because the film having the prints on it is prepared in advance, there are limitations to prints and decorations.

SUMMARY OF THE INVENTION

It is therefore an object of the present invention to provide a transmissive key sheet enabling effective illumination with less quantity of light emitted from a light source and numbers of input keys to be disposed in a small area of small equipment by applying additional new processes to a resin film to produce various new effects while ensuring the thinness of the entire key sheet and suppressing the decrease of light transmission through the use of a combination of translucent resin and a resin film, input keys using the transmissive key sheet, and electronic equipment with the input keys.

In accordance with the first aspect of the present invention, to achieve the object mentioned above, there is provided a transmissive key sheet comprising a first key sheet unit including a first resin film and key tops or keycaps made of translucent resin formed on the first resin film, and a second key sheet unit including a second resin film and pressure applicators made of translucent resin formed on the second resin film correspondingly to the positions of the respective key tops, wherein the opposite side of the first key sheet unit from the key tops and the opposite side of the second key sheet unit from the pressure applicators are bonded together with an adhesive so that the positions of the key tops correspond to the positions of the pressure applicators, respectively.

In accordance with the second aspect of the present invention, in the transmissive key sheet of the first aspect, the first and second resin films have translucency.

In accordance with the third aspect of the present invention, in the transmissive key sheet of the first or second aspect, letters, characters, symbols and the like are printed on the under surface of the first resin film.

In accordance with the fourth aspect of the present invention, in the transmissive key sheet of one of the first to third aspects, the adhesive is a translucent adhesive.

In accordance with the fifth aspect of the present invention, in the transmissive key sheet of one of the first to fourth aspects, reflective material is applied on the opposite side of the first resin film from the key tops or the opposite side of the second resin film from the pressure applicators in such a manner as to avoid portions corresponding to the key tops or the pressure applicators.

In accordance with the sixth aspect of the present invention, in the transmissive key sheet of the fifth aspect, the reflective material is mirror ink or mirror foil.

In accordance with the seventh aspect of the present invention, in the transmissive key sheet of one of the first to fourth aspects, light shielding material is applied on the opposite side of the first resin film from the key tops or the opposite side of the second resin film from the pressure applicators in such a manner as to avoid portions corresponding to the key tops or the pressure applicators.

In accordance with the seventh aspect of the present invention, in the transmissive key sheet of one of the first to fourth aspects, luminous paint is applied to the opposite side of the first resin film from the key tops or the opposite side of the second resin film from the pressure applicators in such a manner as to avoid portions corresponding to the key tops or the pressure applicators.

In accordance with the ninth aspect of the present invention, in the transmissive key sheet of one of the first to eighth aspects, pictures are printed in portions corresponding to the key tops or the pressure applicators on the opposite side of the first resin film from the key tops or the opposite side of the second resin film from the pressure applicators.

In accordance with the tenth aspect of the present invention, in the transmissive key sheet of one of the first to eighth aspects, portions corresponding to the key tops or the pressure applicators are colored on the opposite side of the first resin film from the key tops or the opposite side of the second resin film from the pressure applicators.

In accordance with the eleventh aspect of the present invention, in the transmissive key sheet of one of the first to fourth aspects, luminous material that emits light in response to black light is added to the translucent resin used for at least one of the first and second resin films, the key tops and the pressure applicators.

In accordance with the twelfth aspect of the present invention, the transmissive key sheet of one of the first to eleventh aspects is provided with several types of the first key sheet units and several types of the second key sheet units, wherein the first key sheet unit and the second key sheet unit are used in various combinations as appropriate.

In accordance with the thirteenth aspect of the present invention, there are provided input keys comprising: the transmissive key sheet of one of the first to twelfth aspects; a housing on which the transmissive key sheet is mounted so that the key tops are exposed to outside; a substrate or a circuit board in the housing; key switches on the substrate arranged opposite to the key tops, each of which is pressed through the corresponding pressure applicator by the pressing of the corresponding key top; electrodes on the substrate arranged opposite to the key switches, each of which outputs an electrical signal when brought in contact with the corresponding key switch pressed through the pressure applicator by the pressing of the key top; and a light source arranged in a space between the substrate and the transmissive key sheet, which emits light transmitting through the transmissive key sheet and illuminates the keys.

In accordance with the fourteenth aspect of the present invention, there is provided electronic equipment with the input keys using the transmissive key sheet of one of the first to twelfth aspects.

As described above, in accordance with the present invention, the resin film having letters, symbols, etc. printed on its under surface on the side of the key tops, and the resin film on the side of the pressure applicators are formed separately. The transmissive key sheet is formed of the resin films bonded together with an adhesive. Thereby, the thinness of the entire key sheet can be secured.

Further, in accordance with the present invention, translucent resin is used for all the members including the key tops and the pressure applicators as well as the films provided with them differently from the conventional technique in which the brightness decreases because the silicon rubber assumes a milk-white color. Thus, it is possible to prevent light transmission from decreasing.

BRIEF DESCRIPTION OF THE DRAWINGS

The objects and features of the present invention will become more apparent from the consideration of the following detailed description taken in conjunction with the accompanying drawings in which:

FIG. 4(*a*) showing a plan view of the key sheet unit 1A;

FIG. 4(*b*) showing a longitudinal side view of the key sheet unit 1A;

FIG. 4(*c*) showing a cross section taken along the line A—A in FIG. 4(*a*);

FIG. 4(*d*) showing a transverse side view of the key sheet unit 1A;

FIG. 4(*e*) showing a cross section taken along the line B—B in FIG. 4(*a*);

FIG. 4(*f*) showing a plan view of the backside of the key sheet unit 1A;

FIG. 5(*a*) showing a plan view of the key sheet unit 1B;

FIG. 5(*b*) showing a longitudinal side view of the key sheet unit 1B;

FIG. 5(*c*) showing a cross section taken along the line C—C in FIG. 5(*a*);

FIG. 5(*d*) showing a transverse side view of the key sheet unit 1B;

FIG. 5(*e*) showing a cross section taken along the line D—D in FIG. 5(*a*);

FIG. 5(*f*) showing a plan view of the backside of the key sheet unit 1B;

FIG. 7(*b*) is a longitudinal cross section of the key sheet unit (key sheet unit 1B) depicted in FIG. 7(*a*);

FIG. 7(*c*) is a transverse cross section of the key sheet unit (key sheet unit 1B) depicted in FIG. 7(*a*);

FIG. 9(*b*) is a transverse cross section of the key sheet unit depicted in FIG. 9(*a*);

FIG. 10(*b*) is a transverse cross section of the key sheet unit depicted in FIG. 10(*a*);

FIG. 11(*b*) is a transverse cross section of the key sheet unit depicted in FIG. 11(*a*);

FIG. 12(*b*) is a transverse cross section of the key sheet unit depicted in FIG. 12(*a*).

DESCRIPTION OF THE PREFERRED EMBODIMENTS

Figure 1:
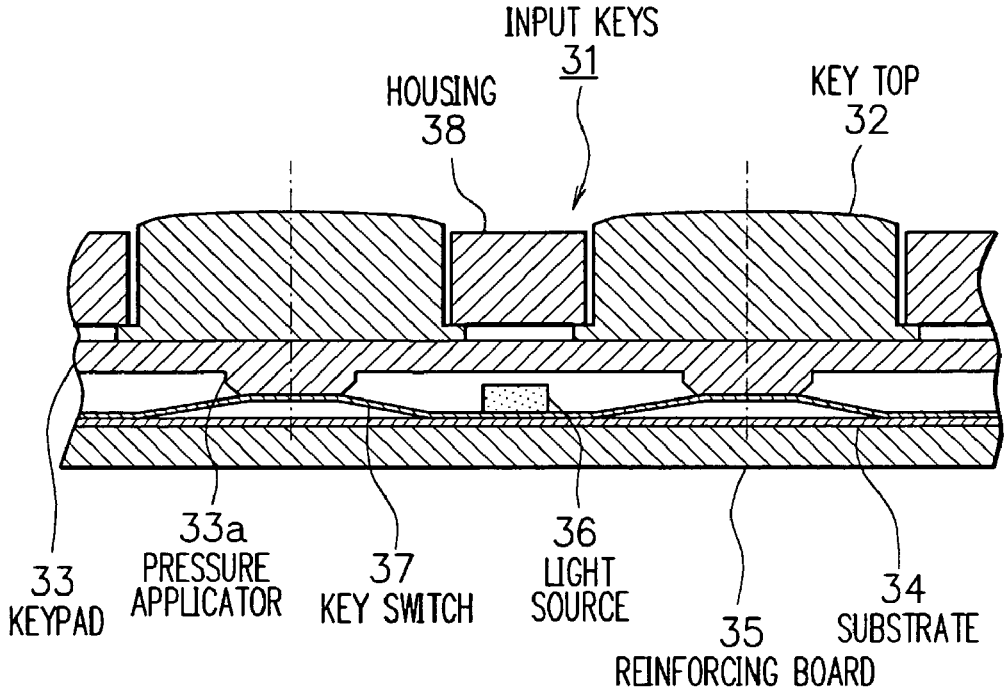
FIG. 1 PRIOR ART
FIG. 1 is a cross section diagram showing an example of the construction of conventional input keys.
Figure 2:
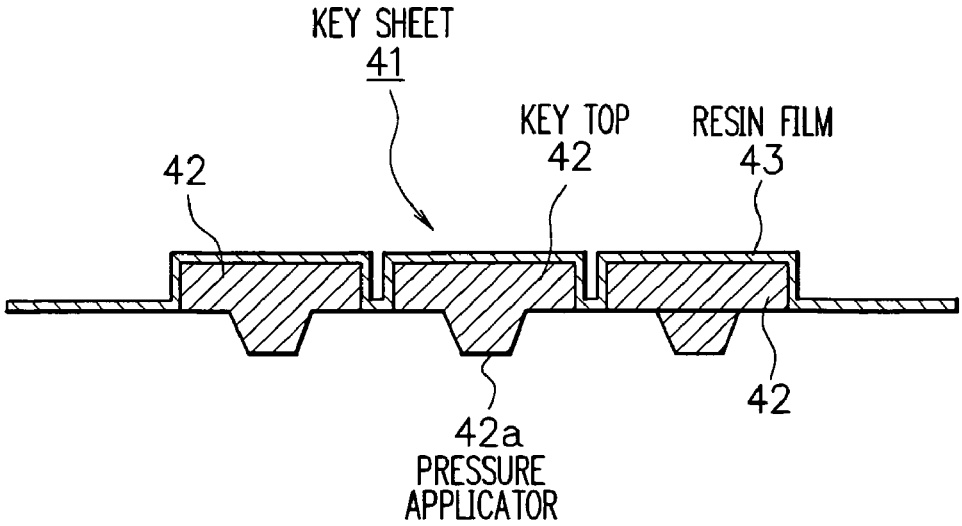
FIG. 2 PRIOR ART
FIG. 2 is a cross section diagram showing an example of the construction of a conventional key sheet formed of key tops integrated with a film.

Referring now to the drawings, a description of preferred embodiments of the present invention will be given in detail.

Figure 3:
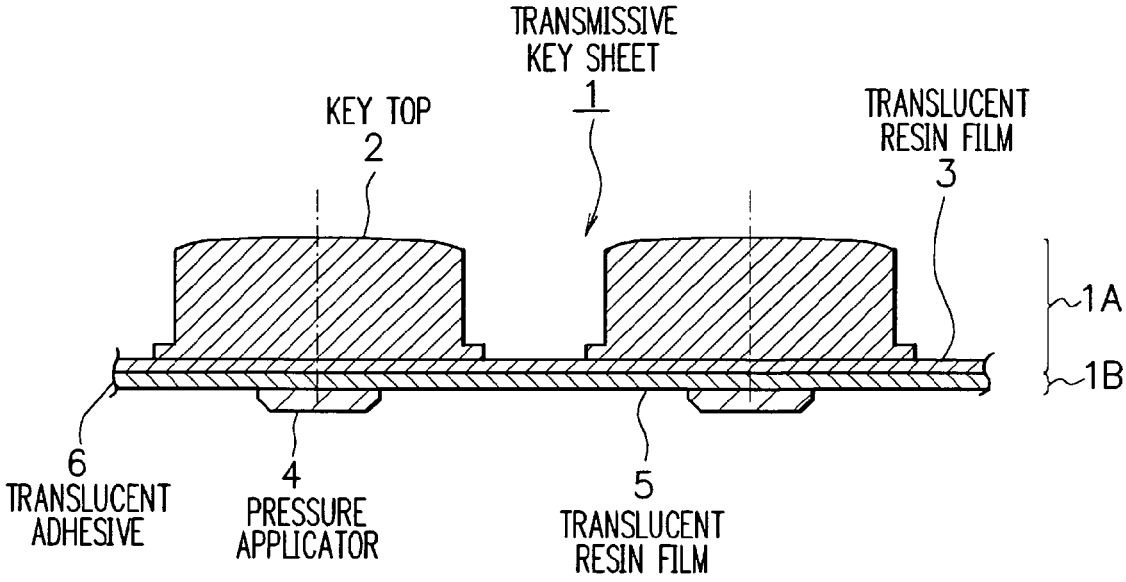
FIG. 3 is a cross section diagram showing a transmissive key sheet according to the first embodiment of the present invention.
Figure 4:
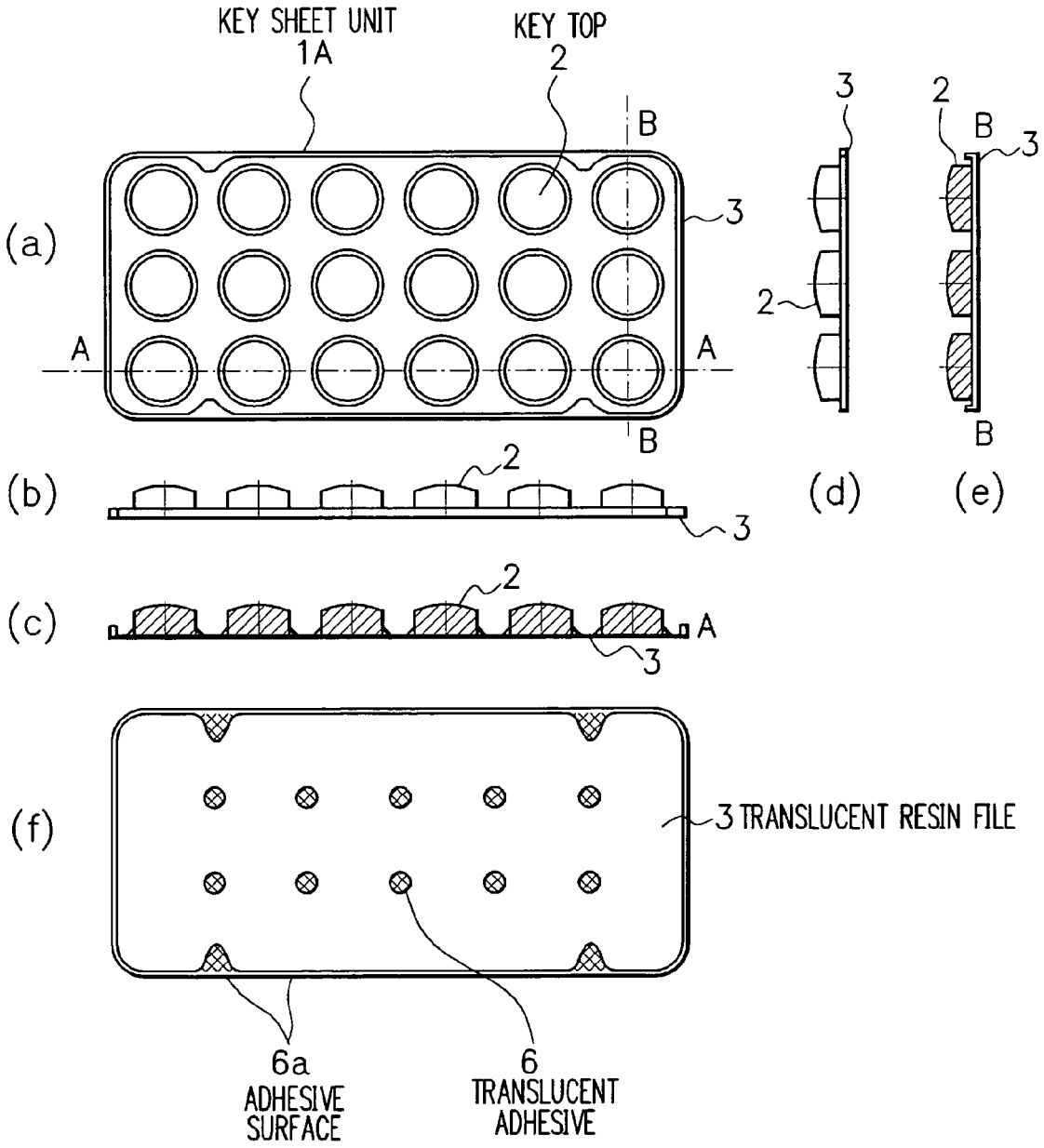
FIG. 4 shows the construction of a key sheet unit 1A as a constituent element of the transmissive key sheet according to the first embodiment, including.
Figure 5:
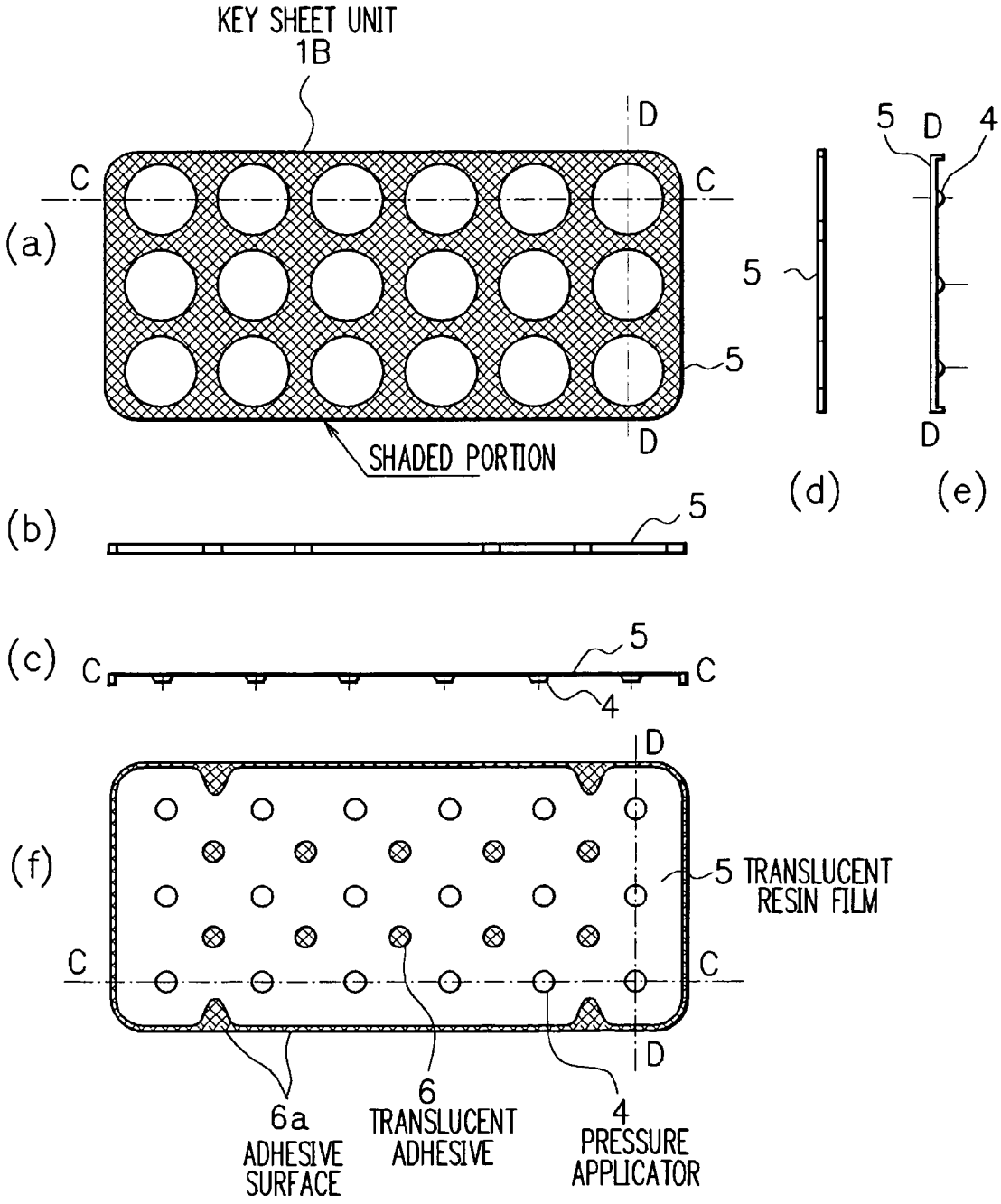
FIG. 5 shows the construction of a key sheet unit 1B as a constituent element of the transmissive key sheet according to the first embodiment, including.
Figure 6:
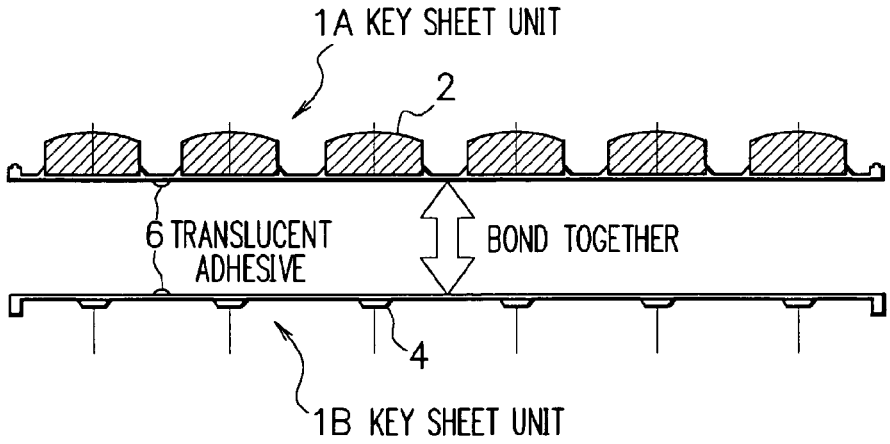
FIG. 6 is a cross section diagram showing the key sheet units 1A and 1B to be bonded together.
Figure 7:
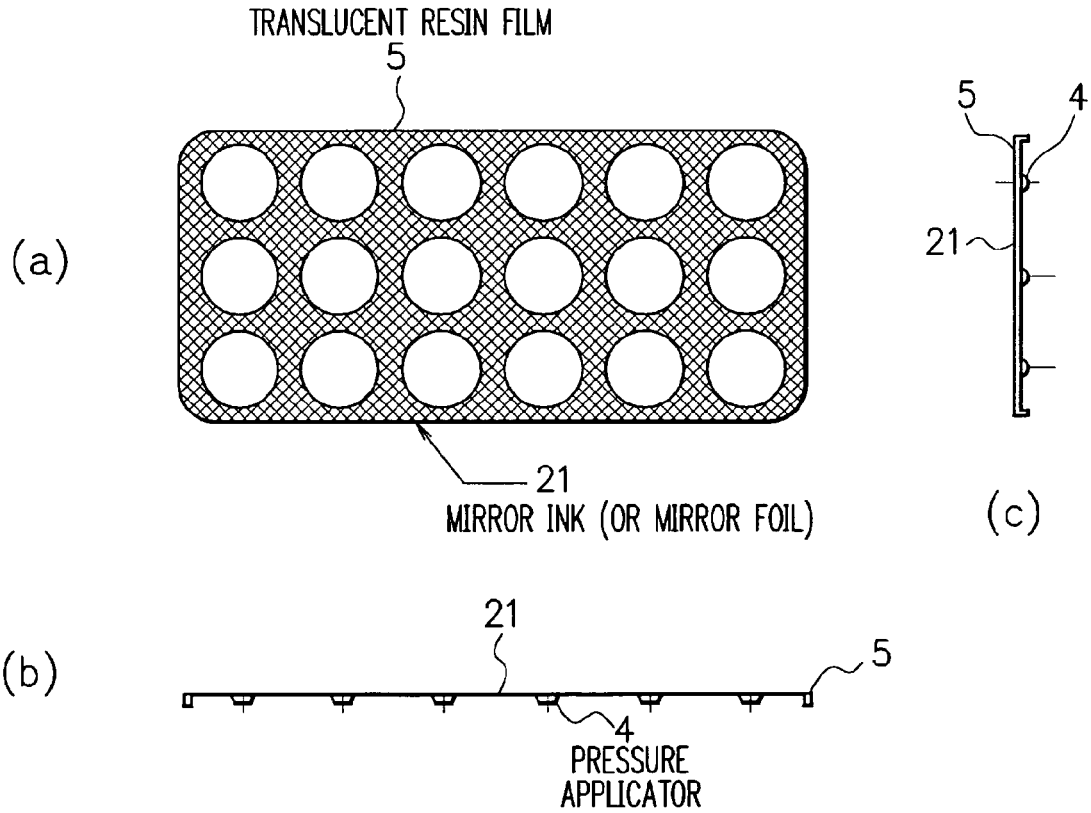
FIG. 7(*a*) is a plan view of one of the key sheet units (key sheet unit 1B) of the first embodiment, on which reflective material is applied.
Figure 8:
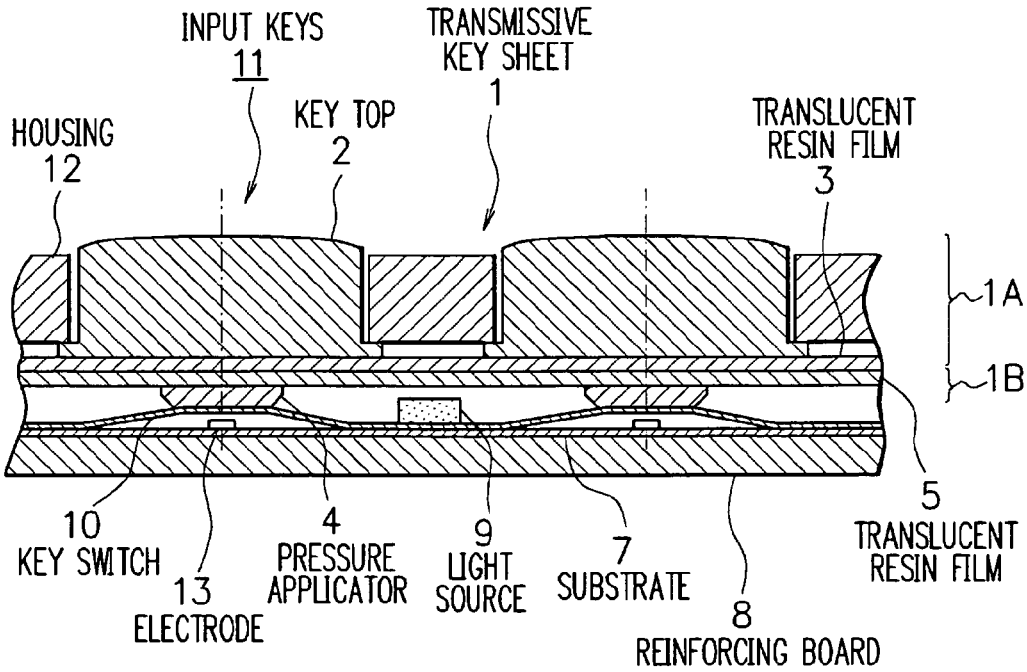
FIG. 8 is a cross section diagram of input keys using the transmissive key sheet of the first embodiment.

FIG. 3 is a cross section diagram showing a transmissive key sheet according to the first embodiment of the present invention. FIGS. 4 and 5 show the constructions of two key sheet units (first and second key sheet units) as constituents of the transmissive key sheet. FIG. 6 is a cross section diagram showing the first and second key sheet units to be bonded together. FIG. 7 is a plan view of one of the key sheet units (second key sheet unit), on which reflective material is applied. FIG. 8 is a cross section diagram of input keys using the transmissive key sheet of the first embodiment.

Referring to FIG. 3, a transmissive key sheet 1 of the first embodiment comprises a key sheet unit 1A (first key sheet unit) and a key sheet unit 1B (second key sheet unit) bonded together with a translucent adhesive 6.

The key sheet unit 1A includes a translucent resin film 3 and key tops or keycaps 2 made of translucent resin. The key tops 2 are molded integral with the translucent resin film 3. Similarly, the key sheet unit 1B includes a translucent resin film 5 and pressure applicators 4 made of translucent resin. The pressure applicators 4 are molded integral with the translucent resin film 5. PET (polyethylene terephthalate) or the like may be used for the translucent resin film. Besides, examples of the translucent resin include polycarbonate resin, transparent acrylic resin, transparent ABS (acrylonitrile-butadiene-styrene) resin, and PMMA (polymethylmethacrylate).

Incidentally, in the first and the following embodiments, the translucent resin film may be a mere resin film as long as it has a prescribed light transmission.

FIG. 4 shows the construction of the key sheet unit 1A in detail. FIG. 4(*a*) is a plan view of the key sheet unit 1A. FIG. 4(*b*) is a longitudinal side view of the key sheet unit 1A. FIG. 4(*c*) is a cross section taken along the line A—A in FIG. 4(*a*). FIG. 4(*d*) is a transverse side view of the key sheet unit 1A. FIG. 4(*e*) is a cross section taken along the line B—B in FIG. 4(*a*). FIG. 4(*f*) is a plan view of the backside of the key sheet unit 1A.

As shown in FIG. 4, a plurality of the key tops 2 made of translucent resin are molded integral with the rectangular translucent resin film 3. The key tops 2 are arranged at equally spaced intervals on the translucent resin film 3 to form the key sheet unit 1A. As can be seen in FIG. 4(*f*), on the backside of the translucent resin film 3, the translucent adhesive 6 is applied to the parts not corresponding to the key tops 2 arranged at equally spaced intervals. The translucent resin film 3 may be provided with an adhesive surface 6*a* formed of translucent adhesive around its backside.

FIG. 5 shows the construction of the key sheet unit 1B in detail. FIG. 5(*a*) is a plan view of the key sheet unit 1B. FIG. 5(*b*) is a longitudinal side view of the key sheet unit 1B. FIG. 5(*c*) is a cross section taken along the line C—C in FIG. 5(*a*). FIG. 5(*d*) is a transverse side view of the key sheet unit 1B. FIG. 5(*e*) is a cross section taken along the line D—D in FIG. 5(*a*). FIG. 5(*f*) is a plan view of the backside of the key sheet unit 1B.

As shown in FIG. 5, a plurality of the pressure applicators 4 made of translucent resin are molded integral with the rectangular translucent resin film 5. The pressure applicators 4 are arranged at equally spaced intervals on the translucent resin film 5 to form the key sheet unit 1B. The pressure applicators 4 correspond in number with the key tops 2 shown in FIG. 4, and are arranged at the same intervals as with the key tops 2. As can be seen in FIG. 5(*f*), on the translucent resin film 5, the translucent adhesive 6 is applied to the parts not corresponding to the pressure applicators 4 arranged at equally spaced intervals. The translucent resin film 5 may be provided with an adhesive surface 6*a* formed of translucent adhesive around it. Incidentally, the translucent adhesive 6 and the adhesive surface 6*a* are actually provided to the upper surface of the translucent resin film 5. The shaded portion in FIG. 5(*a*) indicates the area where reflective material, light shielding material, luminous paint or the like may be applied, which will be described later.

The key sheet units 1A and 1B having the construction described above are bonded together as shown in FIG. 6. More specifically, the opposite side of the key sheet unit 1A from the key tops 2 and the opposite side of the key sheet unit 1B from the pressure applicators 4 are bonded together with the translucent adhesive 6 so that the key tops 2 correspond in position with the pressure applicators 4, respectively. By bonding and fixing the key sheet units together in this manner, it becomes possible to prevent misalignment between the centers of the key tops 2 and the pressure applicators 4 in each case of key operation.

While, in the above description, the translucent adhesive 6 is applied to the parts not corresponding to the key tops 2 and the pressure applicators 4, the translucent adhesive 6 may be applied to larger or more parts to improve adhesion properties if the translucent adhesive has perfect translucency and transparency.

Various letters, symbols, etc. necessary for designating respective keys can be printed on the under surface of the translucent resin film 3. Heretofore, pressure applicators cannot be formed when letters are printed on the under surfaces of key tops made of translucent resin, and therefore, an additional silicone rubber sheet for forming pressure applicators has been necessary. Such additional silicone rubber sheet has caused an increase in thickness and necessitated a decrease in light transmission. On the other hand, in the transmissive key sheet 1 of this embodiment, letters can be printed on the flat under surface of the translucent resin film 3, and the pressure applicators 4 are formed on the translucent resin film 5 on the side of the key sheet unit 1B. Thus, it is possible to ensure the thinness of the entire key sheet and prevent the decrease of light transmission.

In the first embodiment, reflective material may be applied on one or the other of the key sheet units as shown in FIG. 7. In the example of FIG. 7, to the opposite side of the translucent resin film 5 of the key sheet unit 1B from the pressure applicators 4 is applied reflective material, such as mirror ink or mirror foil 21, or white, etc. having high reflectance, in such a manner as to avoid portions corresponding to the pressure applicators 4 as indicated by the shaded area. The reflective material may be applied to the opposite side of the translucent resin film 3 of the key sheet unit 1A from the key tops 2 in such a manner as to avoid portions corresponding to the key tops 2.

FIG. 8 shows the construction of input keys using the transmissive key sheet of the first embodiment.

Referring to FIG. 8, input keys 11, in the operating part of the input device of various types of mobile communication equipment or terminal equipment, includes: the transmissive key sheet 1; a housing 12 on which the transmissive key sheet is mounted so that the key tops 2 made of translucent resin are exposed to outside; a substrate 7 in the housing 12; a reinforcing board 8 for supporting the substrate 7; key switches 10 on the substrate 7 arranged opposite to the key tops, each being made of a convex conductive leaf; electrodes 13 on the substrate 7 under the respective key switches 10; and a light source 9 arranged in a space between the substrate 7 and the transmissive key sheet 1. Incidentally, the aforementioned reflective material, such as mirror ink or mirror foil 21 shown in FIG. 7, is applied on the key sheet unit 1B of the transmissive key sheet 1.

In the input keys 11 of this construction, when each key top 2 of the transmissive key sheet 1 is pressed, the key switch 10 is pressed through the pressure applicator 4 and concavely curved, thereby making a contact with the electrode 13 on the substrate 7. Thus, key input is provided. The light from the light source 9 on the substrate 7 transmits through the translucent pressure applicators 4, resin films 3 and 5, and keypads 2, and illuminates the keys to make letters, symbols, etc. printed on the under surface of the translucent resin film 3 visible from outside through the key tops 2. Since the reflective material is applied on the key sheet unit 1B, the reflection of light from the light source 9 is enhanced by the reflective material. Consequently, the light fills the space with increased brightness and is fully emitted through the transmissive key sheet 1 to the outside as key lighting. Thus, effective illumination is possible with less quantity of light from the light source. Instead of the key sheet unit 1B, the reflective material may be applied to the opposite side of the key sheet unit 1A from the key tops 2 in such a manner as to avoid portions corresponding to the key tops 2.

In the following, a description will be given of key sheet units of the input keys 11 according to other embodiments of the present invention. For sake of simplicity, only the second key sheet unit (corresponding to the key sheet unit 1B of the first embodiment) of other embodiments will be described.

Figure 9:
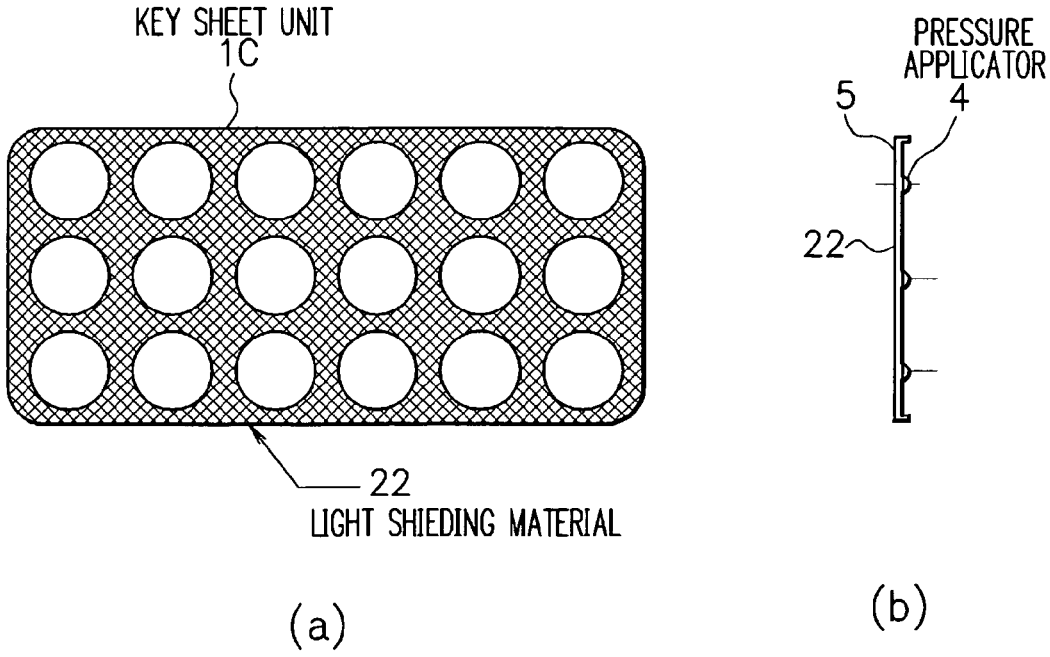
FIG. 9(*a*) is a plan view of a key sheet unit according to the second embodiment of the present invention.
Figure 10:
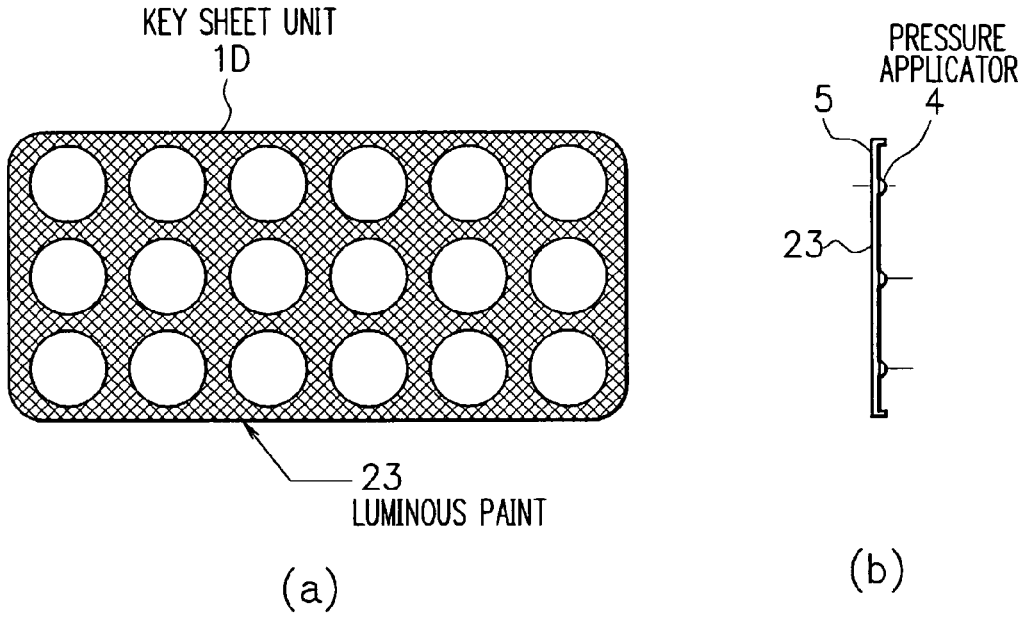
FIG. 10(*a*) is a plan view of a key sheet unit according to the third embodiment of the present invention.

FIGS. 9(*a*) and 9(*b*) are a plan view and a sectional side view of the second key sheet unit according to the second embodiment of the present invention, respectively. FIGS. 10(*a*) and 10(*b*) are a plan view and a sectional side view of the second key sheet unit according to the third embodiment of the present invention, respectively.

As shown in FIG. 9, a key sheet unit 1C of the second embodiment includes the translucent resin film 5, to the side of which opposite the pressure applicators 4 arranged at equally spaced intervals is applied light shielding material 22 in such a manner as to avoid portions corresponding to the pressure applicators 4. The light shielding material 22 has a black color or the like with high opacifying power and low reflectance. When the key sheet unit 1C is used instead of the key sheet unit 1B of the input keys 11 shown in FIG. 8, the light shielding material 22 prevents light from leaking out from improper parts. In addition, the light shielding material 22 can cover the portion where the light source 9 is disposed so that the light from the light source 9 is not directly emitted from the key tops 2.

As can be seen in FIG. 10, a key sheet unit 1D of the third embodiment includes the translucent resin film 5, to the side of which opposite the pressure applicators 4 arranged at equally spaced intervals is applied luminous paint 23 in such a manner as to avoid portions corresponding to the pressure applicators 4. When the key sheet unit 1D is used instead of the key sheet unit 1B of the input keys 11 shown in FIG. 8, the luminous paint 23 accumulates the light from the light source 9. Consequently, the light can be emitted even after the light source is turned off and utilized as an auxiliary lighting.

Figure 11:
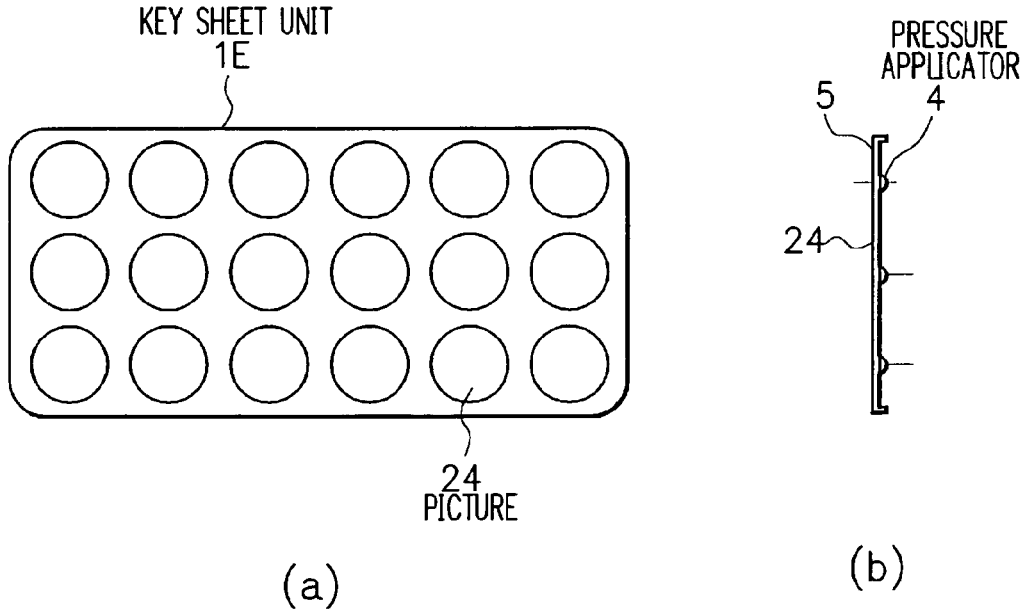
FIG. 11(*a*) is a plan view of a key sheet unit according to the fourth embodiment of the present invention.

FIGS. 11(*a*) and 11(*b*) are a plan view and a sectional side view of the second key sheet unit according to the fourth embodiment of the present invention, respectively.

As shown in FIG. 11, a key sheet unit 1E of the fourth embodiment includes the translucent resin film 5, on the side of which opposite the pressure applicators 4 arranged at equally spaced intervals are printed pictures 24 in such a manner as to correspond to the pressure applicators 4. The pictures 24 can be varied according to positions corresponding to the respective pressure applicators 4. When the key sheet unit 1E is used instead of the key sheet unit 1B of the input keys 11 shown in FIG. 8, the respective pictures 24 are illuminated with the light from the light source 9 through the pressure applicators 4, and become visible from outside through the key sheet unit 1A on the surfaces of the key tops 2. Thus, pictures necessary for designating respective keys are visible on the key tops 2 of the input keys 11.

Incidentally, for the key sheet unit 1E of the fourth embodiment, the printing of the pictures may be performed in combination with the application of the reflective material, light shielding material or luminous paint of the first to third embodiments.

Figure 12:
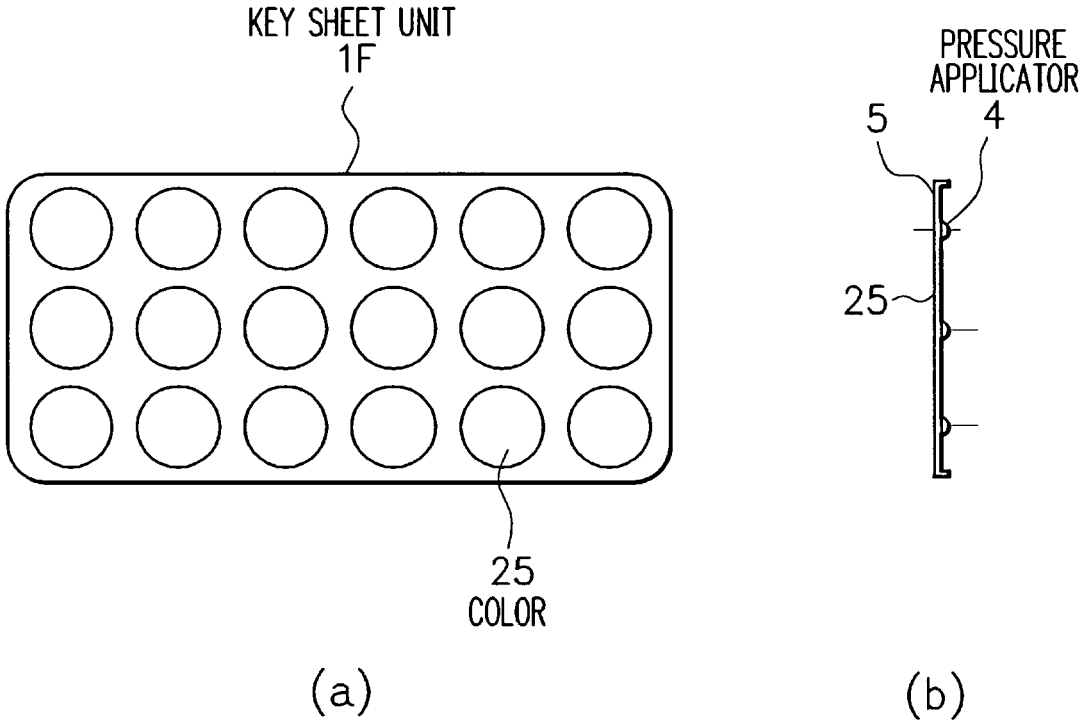
FIG. 12(*a*) is a plan view of a key sheet unit according to the fifth embodiment of the present invention.

FIGS. 12(*a*) and 12(*b*) are a plan view and a sectional side view of the second key sheet unit according to the fifth embodiment of the present invention, respectively.

As can be seen in FIG. 12, a key sheet unit 1F of the fifth embodiment includes the translucent resin film 5, on the side of which opposite the pressure applicators 4 arranged at equally spaced intervals are provided colored portions 25 in such a manner as to correspond to the pressure applicators 4. The colored portions 25 can be varied in color according to positions corresponding to the respective pressure applicators 4, which allows flexibility in coloring. When the key sheet unit 1F is used instead of the key sheet unit 1B of the input keys 11 shown in FIG. 8, the respective colored portions 25 are illuminated with the light from the light source 9 through the pressure applicators 4, and become visible from outside through the key sheet unit 1A on the surfaces of the key tops 2. Thus, colors necessary for designating respective keys are visible on the key tops 2 of the input keys 11.

Incidentally, for the key sheet unit 1F of the fifth embodiment, the coloring may be performed in combination with the application of the reflective material, light shielding material or luminous paint of the first to third embodiments.

While the second key sheet unit is provided with the reflective material, light shielding material, luminous paint, pictures, and coloring in the above-described first to fifth embodiments, respectively, the first key sheet unit, i.e. the key sheet unit 1A shown in FIG. 4, may be provided with them on the side opposite the key tops 2.

In the following, the sixth embodiment of the present invention will be described. According to the sixth embodiment, luminous material is added to the key sheet unit.

In the sixth embodiment, although not shown in the drawings, luminous material that emits light in response to black light is added to and mixed with the material used for at least one selected from the key tops 2 of the key sheet unit 1A, the translucent resin film 3 shown in FIG. 4, the pressure applicators 4 of the key sheet unit 1B, and the translucent resin film 5 shown in FIG. 5.

When the input keys 1 having such key sheet unit(s), to which the luminous material is added, are illuminated by black light, the luminous material emits light in response to the black light. Consequently, the key tops 2 shine to be easily viewable, and the decorative effect on the entire key tops are further enhanced.

In the following, the seventh embodiment of the present invention will be described. According to the seventh embodiment, the transmissive key sheet is provided with several types of the first and second key sheet units, and the first and second key sheet units are used in various combinations as appropriate.

In the example of FIGS. 3 to 5, plural types of the key sheet units 1A and 1B are prepared for the transmissive key sheet 1. The types of the key sheet units may be increased by, for example, preparing the key sheet units 1A having the key tops 2 of different heights and the key sheet units 1B having the pressure applicators 4 of different heights, or preparing the key sheet units of the same key pitch with different designs of the key tops 2 or the prints.

Through the use of the key sheet units 1A and 1B in various combinations as appropriate, for example, operationality can be changed by adjusting the height of the key tops 2 while the same click feeling is maintained, or the click feeling can be changed by adjusting the height of the pressure applicators 4 while the key tops 2 remain at the same height. In this manner, the transmissive key sheet 1 can assume varied forms so as to be suit to the operationality desired by the user. In addition, by using the key sheet units with different designs in various combinations as appropriate, it is possible to change the decorated surface of the transmissive key sheet 1.

As set forth hereinabove, in accordance with the present invention, a resin film with key tops and a resin film with pressure applicators are formed separately, and a transmissive key sheet is formed of the resin films bonded together with an adhesive. Thereby, the thinness of the entire key sheet can be secured.

Further, translucent resin is used for the key tops, the pressure applicators and the resin films. Thus, it is possible to prevent light transmission from decreasing.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A transmissive key sheet comprising a first key sheet unit including a first resin film and key tops made of translucent resin formed on the first resin film, and a second key sheet unit including a second resin film and pressure applicators made of translucent resin formed on the second resin film correspondingly to the positions of the respective key tops:

wherein the opposite side of the first key sheet unit from the key tops and the opposite side of the second key sheet unit from the pressure applicators are bonded together with an adhesive so that the positions of the key tops correspond to the positions of the pressure applicators, respectively.

2. The transmissive key sheet claimed in claim 1, wherein the first and second resin films have translucency.

3. The transmissive key sheet claimed in claim 1, wherein letters are printed on the under surface of the first resin film.

4. The transmissive key sheet claimed in claim 1, wherein the adhesive is a translucent adhesive.

5. The transmissive key sheet claimed in claim 1, wherein reflective material is applied on the opposite side of the first resin film from the key tops or the opposite side of the second resin film from the pressure applicators in such a manner as to avoid portions corresponding to the key tops or the pressure applicators.

6. The transmissive key sheet claimed in claim 5, wherein the reflective material is mirror ink or mirror foil.

7. The transmissive key sheet claimed in claim 1, wherein light shielding material is applied on the opposite side of the first resin film from the key tops or the opposite side of the second resin film from the pressure applicators in such a manner as to avoid portions corresponding to the key tops or the pressure applicators.

8. The transmissive key sheet claimed in claim 1, wherein luminous paint is applied to the opposite side of the first resin film from the key tops or the opposite side of the second resin film from the pressure applicators in such a manner as to avoid portions corresponding to the key tops or the pressure applicators.

9. The transmissive key sheet claimed in claim 1, wherein pictures are printed in portions corresponding to the key tops or the pressure applicators on the opposite side of the first resin film from the key tops or the opposite side of the second resin film from the pressure applicators.

10. The transmissive key sheet claimed in claim 1, wherein portions corresponding to the key tops or the pressure applicators are colored on the opposite side of the first resin film from the key tops or the opposite side of the second resin film from the pressure applicators.

11. The transmissive key sheet claimed in claim 1, wherein luminous material that emits light in response to black light is added to the translucent resin used for at least one of the first and second resin films, the key tops and the pressure applicators.

12. The transmissive key sheet claimed in claim 1, further comprising several types of the first key sheet units and several types of the second key sheet units:

wherein the first key sheet unit and the second key sheet unit are used in various combinations as appropriate.

13. Input keys comprising:

the transmissive key sheet claimed in claim 1;

a housing on which the transmissive key sheet is mounted so that the key tops are exposed to outside;

a substrate in the housing;

key switches on the substrate arranged opposite to the key tops, each of which is pressed through the pressure applicator by the pressing of the key top;

electrodes on the substrate arranged opposite to the key switches, each of which outputs an electrical signal when brought in contact with the key switch pressed through the pressure applicator by the pressing of the key top; and a light source arranged in a space between the substrate and the transmissive key sheet, which emits light transmitting through the transmissive key sheet and illuminates the keys.

14. Electronic equipment with the input keys including the transmissive key sheet claimed in claim 13.

* * * * *